US007386943B2

(12) United States Patent
Gomi

(10) Patent No.: US 7,386,943 B2
(45) Date of Patent: Jun. 17, 2008

(54) CLOTHES PRESSING METHOD AND APPARATUS

(76) Inventor: Yoshimasa Gomi, 3670, Oaza Kasahata, Kawagoe, Saitama (JP) 350-1175

( * ) Notice: Subject to any disclaimer, the term of this patent is extended or adjusted under 35 U.S.C. 154(b) by 191 days.

(21) Appl. No.: 11/207,769

(22) Filed: Aug. 22, 2005

(65) Prior Publication Data

US 2006/0037212 A1 Feb. 23, 2006

(30) Foreign Application Priority Data

Aug. 23, 2004 (JP) ..... 2004-242021

(51) Int. Cl.
*F26B 9/04* (2006.01)

(52) U.S. Cl. ..... 34/143; 34/103; 223/57; 223/67

(58) Field of Classification Search ..... 223/57, 223/66, 67, 70, 73; 34/143, 145, 146, 397, 34/398, 69, 70, 71, 60, 61, 103
See application file for complete search history.

(56) References Cited

U.S. PATENT DOCUMENTS 3,583,610 A * 6/1971 Forse ..... 223/57
4,351,457 A * 9/1982 Engelbart ..... 223/57

FOREIGN PATENT DOCUMENTS

JP 5-96093 4/1993

* cited by examiner

*Primary Examiner*—Kenneth Rinehart
(74) *Attorney, Agent, or Firm*—Leydig, Voit & Mayer, Ltd.

(57) ABSTRACT

A clothes pressing apparatus has a body block movable between a supply position at which an article of clothing can be placed on the body block and a press position at which pressing work can be achieved. A sleeve holder is also mounted on the base for holding sleeves of the an article of clothing and having a sleeve tucking iron. Also included are a body air supply device for supplying a first air blast suitable for pressing the body portion of the article of clothing, and a sleeve air supply device for supplying a second air blast for pressing the sleeve portion. The apparatus further includes a controller for operating the sleeve air supply device for supplying the second air blast only when the body air supply device is operated for supplying the first air blast.

10 Claims, 4 Drawing Sheets

FIG. 5

Pressing Operation
Step Chart

| Steps | Maneuver | Machine operations | Body iron | Side & shoulder air bags | Sleeve |
|---|---|---|---|---|---|
| 1 | Place clothes on body block | Body block in supply position | | | |
| 2 | Turn on body block moving switch | Body block moves to pressing position | | | |
| 3 | | Sleeve holder moves forward | | | |
| 4 | | Air pipes connected | | | |
| 5 | | Body irons start press operation | ↓ | | |
| 6 | | Blast hot air into air bags | ↓ | ↓ | |
| 7 | Hold sleeves on the holders | Hold sleeve cuffs | ↓ | ↓ | |
| 8 | Turn on press finish start switch | Extend sleeves outward | ↓ | ↓ | |
| 9 | | Blast hot air into sleeves | ↓ | ↓ | ↓ |
| 10 | | Press tucked portions of the sleeve | ↓ | ↓ | ↓ |
| 11 | | Press completed after a predetermind time | ↓ | ↓ | ↓ |
| 12 | | Body block moves to supply position | | | |

CLOTHES PRESSING METHOD AND APPARATUS

BACKGROUND OF THE INVENTION

This invention relates to a clothes pressing method and apparatus for pressing clothes such as a dress shirt placed on a body block by blasting hot air (a hot blast) into the entire of a body portion, including side portions and a shoulder portion, as well as sleeve portions.

The conventional clothes pressing apparatus of this kind generally comprises an air supply means of a single system composed of a single air supply source (blower) and a single air conduit system for shunting and supplying air into different positions of the clothes. In a clothes pressing apparatus proposed by the same assignee of this application in a Japanese Patent Application Laid-Open No. 5-96093, paragraph 0019 of the specification, in particular, air supplying means having only one system supplies air blasts to both of the body portion and the sleeve portions of the clothes.

However, the following inconvenience has been experienced with the clothes pressing apparatus that employs a single common air supply system for the body portion and the sleeve portions of the clothes.

That is, an air bag that suitably inflates when air is introduced is provided in the body portion, either in the entire body portion or in some portion of the body portion such as shoulder or side portions, and the respective portions are expanded by the inflated air bag from inside to be press-finished. As for the sleeve portions, however, they are lightly pulled to be stretched to their lengths and air is blasted into the sleeves from the shoulder openings of the body with the sleeves (cuffs) closed so that the cylindrical sleeve portions are directly inflated and pressed by the blasted air without using air bags.

Thus, the body portion of the clothes, such as a dress shirt or the like, is pressed by means of the inflated air bag, but the sleeve portions, which are formed by a relatively thin clothes material, are pressed by the air directly blasted into the sleeve portions. Therefore, the press conditions, such as air supply pressure, supply amount, supply time period, supply temperature or the like, cannot be separately optimized for the body portion and the sleeve portions of the clothes with the conventional pressing apparatus employing a common single air supply system. Therefore it was very difficult that the body portion and the sleeve portions be pressed to the satisfactory conditions.

On the other hand, if the pressing operations suitable for the body portion and the sleeve portions, respectively, are desired to be achieved with the air supply apparatus of a single air supply system, the pressing operations of different pressing conditions must be carried out in succession, resulting in an elongated pressing operation and decrease in productivity.

SUMMARY OF THE INVENTION

The present invention aims at the solution of the above problems and has as its object the provision of a clothes pressing apparatus and a clothes pressing method capable of establishing the optimum pressing conditions with respect to each of the body portion and the sleeve portions, achieving an ideal press-finishing.

According to one aspect of the present invention, there is provided a clothes pressing method for pressing clothes with a clothes pressing apparatus that comprises a body block having a body air bag and a sleeve air supply port, a body iron, a sleeve holder, body air supply means and sleeve air supply means, comprising the steps of: placing the clothes on a body block having a body air bag and a sleeve air supply port, supplying a first air blast of a first press conditions for pressing the body portion of the clothes to the body air bag to press the body portion, and supplying a second air blast of a second press conditions different from the first press conditions, only during the supply of the first air blast, for pressing the sleeve portion of the clothes to press the sleeve portion.

Another aspect of the present invention is that the first air blast and the second air blast are stopped substantially at the same time.

Another aspect of the present invention is that the apparatus further comprises, after the step of placing clothes on the body block, the step of moving the body block from a supply position at which the clothes is placed on the body block to a press position at which the pressing of the clothes on the body block can be achieved.

Another aspect of the present invention is that the distance of the movement of the body block is such that one of the sleeve tucks of the clothes placed on the body block moved to the press position is within the region of the supply position.

Another aspect of the present invention is that one of the sleeve holders disposed at both sides of the body block for holding the sleeve cuffs of both sleeve cuffs of the clothes placed on the body block is retreated from a body block movement space when the body block is to be moved between the supply position and the press position.

Another aspect of the present invention is that the body iron, the body air supply means, the sleeve air supply means and finally the sleeve tuck iron are operated in the named order, and wherein the operations of the body air supply means, the sleeve air supply means, and sleeve tuck iron are terminated at substantially the same time.

Another aspect of the present invention is that the sleeves of the clothes placed on the body block are held by the sleeve holders after the body block stops at the pressing position and prior to the supplying of the air to the sleeve.

The present invention also resides in a clothes pressing apparatus that comprises a body block having a body air bag and a sleeve air supply port, a body iron, body air supply means for supplying a first air blast of a first press conditions for pressing the body portion of the clothes to the body air bag to press the body portion of the clothes, sleeve air supply means for supplying a second air blast of a second press conditions different from the first press conditions for pressing the sleeve portion of the clothes to press the sleeve portion of the clothes, and controller means for operating said sleeve air supply means for supplying the second air blast only when the body air supply means is operated for supplying the first air blast.

Another aspect of the present invention is that the apparatus further comprises a base movably supporting said body block, said body block being movable between a supply position at which the clothes to be pressed can be placed on the body block and a press position to which the body block can be transversely movable from the supply position and at which the press work can be achieved. Also provided is a sleeve holder mounted on said base for holding sleeves and having a sleeve tucking iron. The controller means controls each of the above means, and initiating air supply operation of the sleeve air supplying means after a lapse of a predetermined period of time after the initiation of the air supply operation of the body air supplying means.

Another aspect of the present invention is that the predetermined time period is a time necessary for concurrently completing the pressing of the body and the sleeve portions of the clothes.

Another aspect of the present invention is that the distance of the movement of the body block is such that one of the sleeve tucks of the clothes placed on the body block moved to the press position is within the region of the supply position.

Another aspect of the present invention is that the sleeve holder is movable between an operable position at which the sleeve holder is located at a side of the body block and a retreated position at which the sleeve holder is retreated to allow the body block to move between the supply position and the press position.

Another aspect of the present invention is that the controller means initiate operations of the body iron, the body air supply means, the sleeve air supply means and finally the sleeve tucking iron in the named order, and wherein the controller terminates the operations of the body air supply means, the sleeve air supply means, and sleeve tucking iron at substantially the same time.

According to the present invention, a clothes pressing method for pressing clothes with a clothes pressing apparatus that comprises a body block having a body air bag and a sleeve air supply port, a body iron, a sleeve holder, body air supply means and sleeve air supply means, comprising the steps of: placing the clothes on a body block having a body air bag and a sleeve air supply port, supplying a first air blast of a first press conditions for pressing the body portion of the clothes to the body air bag to press the body portion, and supplying a second air blast of a second press conditions different from the first press conditions, only during the supply of the first air blast, for pressing the sleeve portion of the clothes to press the sleeve portion, so that the press conditions such as air supply or the like to the body portion and the sleeve portions can be separately optimized for the respective portions, the body portion and the sleeve portions can be pressed to the satisfactory conditions.

Also, according to the present invention, the press operation can be initiated on the body portion or shoulder, side or other portions such as front body portion that dry more slowly as compared to the sleeve portions prior to the press operation on the sleeve portions, so that the ideal press-finish can be realized.

Also, according to the present invention, the pressing operation for the sleeve portions can be completed within the operating time for the body portion or shoulders or sides or the like such as front body that need a longer pressing operation time as compared to the sleeve portions (sleeves), so that the pressing operation can be achieved within a minimum time and the productivity can be improved in the clothes pressing apparatus pressing the body portion and the sleeve portions.

Also, according to the present invention, the working load of the clothes pressing personnel can be alleviated, contributing to the improvements in the working environments and the productivity.

BRIEF DESCRIPTION OF THE DRAWINGS

The present invention will become more readily apparent from the following detailed description of the present invention taken in conjunction with the accompanying drawings, in which:

FIG. 5 is a chart indicating the procedure of the pressing operation.

DESCRIPTION OF THE PREFERRED EMBODIMENTS

Figure 1:
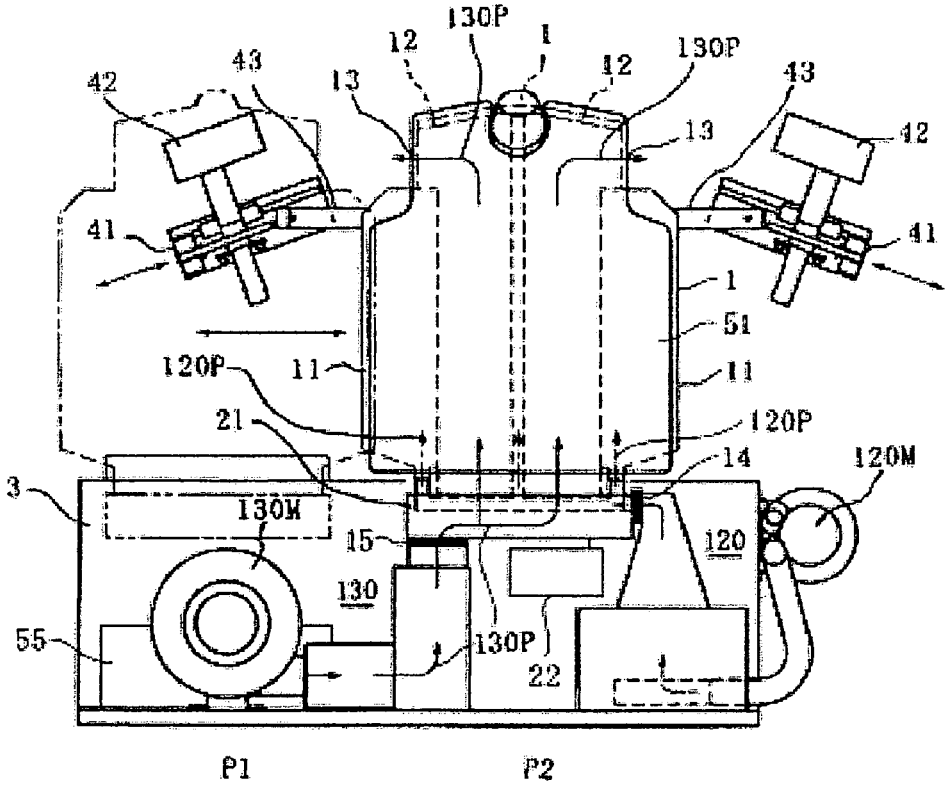
FIG. 1 is a front view of the clothes pressing apparatus of the present invention with the body block illustrated in the supply position in phantom and in solid line in the pressing position.
Figure 2:
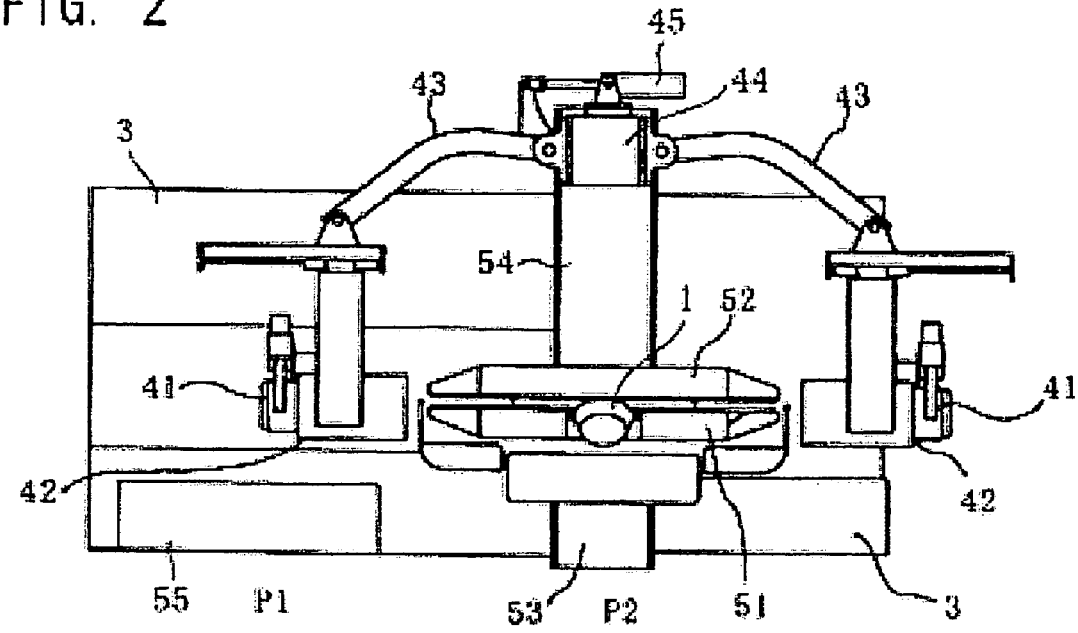
FIG. 2 is a plan view of the clothes pressing apparatus of the present invention with the body block in the pressing position.
Figure 3:
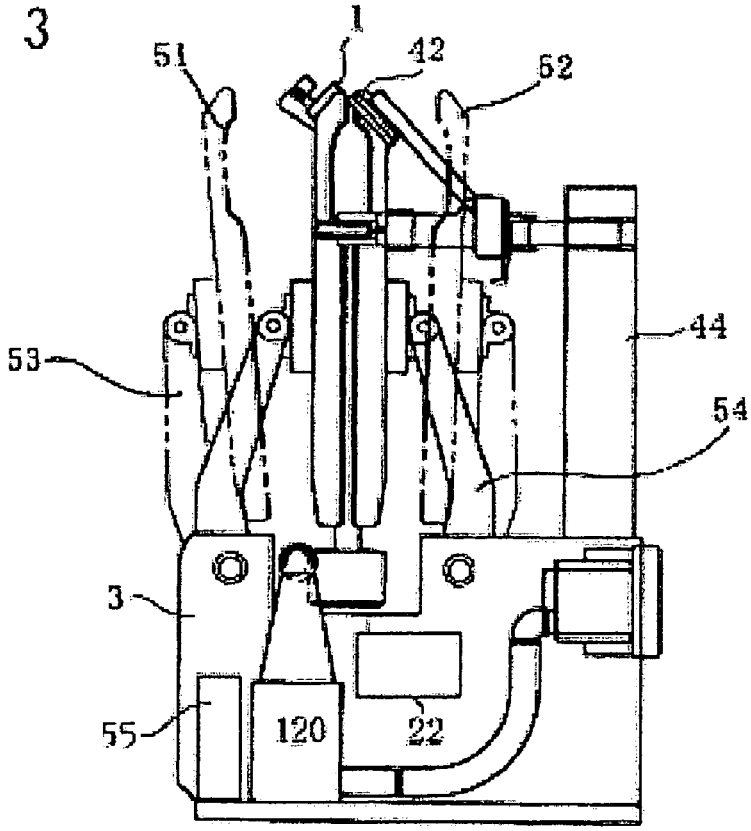
FIG. 3 is a right-hand side view of the clothes pressing apparatus of the present invention in the pressing state on the body block.
Figure 4:
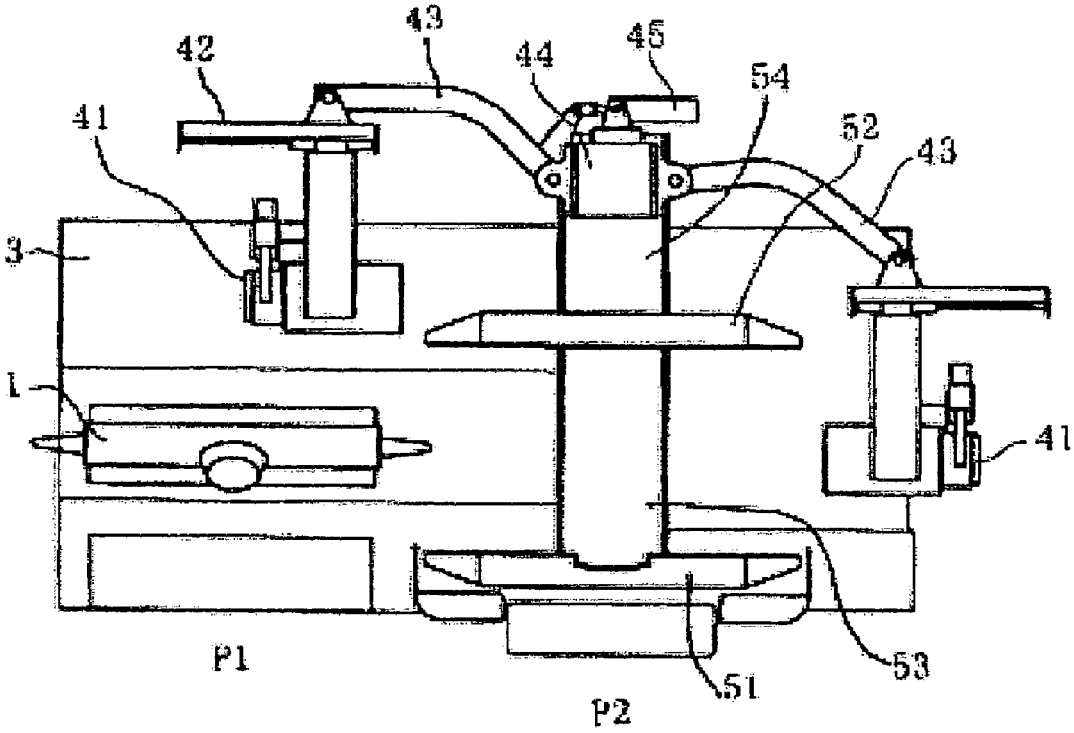
FIG. 4 is a plan view of the clothes pressing apparatus of the present invention with the body block in the supply position.

The present invention will now be described in conjunction with a clothes pressing apparatus that is illustrated in FIGS. 1 to 5 and that comprises a body block having a body air bag and a sleeve air supply port, body block moving means, a sleeve holder having a sleeve tucking iron, sleeve holder moving means, and controller means for controlling each of the above means. FIG. 1 is a front view of the clothes pressing apparatus of the present invention in the state where the body block is in the pressing operation position (the body block in phantom illustrates the supply position) and the sleeve holders are in the operable positions, FIG. 2 is a plan view of the clothes pressing apparatus where the body block is in the pressing position and the sleeve holders are in the operable positions, FIG. 3 is a right hand side view showing the pressing state on the body portion (the broken lines illustrate the body irons in the open positins), FIG. 4 is a plan view in which the body block is in the supply position but one of the sleeve holders is in the retreated position, and FIG. 5 is a pressing operation diagram illustrating how each of the steps of the pressing operation is carried out.

In FIGS. 1 to 3, the reference numeral. 1 in the figure represents a body block on which clothes such as a dress shirt is to be placed as the subject to be pressed. The body block 1 comprises side air bags 11, 11 disposed at both side portions as body air bags and shoulder air bags 12, 12 disposed at both shoulder portions, and the body block 1 is also provided a sleeve air supply ports 13, 13 at both shoulder portions for blasting air into the sleeves of the clothes placed on the body block 1 from air conduit 130 disposed within the body block 1.

The body block 1 is mounted on the moving bed 21 that constitutes body block moving means and arranged to be movable, by the moving bed 21 that is movable on the pressing apparatus base 3 by a moving mechanism 22, in a straight, horizontal, reciprocating movement (transverse movement), between a supply position P1 at which the clothes can be placed on or detached from the body block 1 by the operating personnel and a press position P2 at which the clothes placed on the body block 1 is pressed.

It is to be noted that, while the body block 1 of this embodiment is arranged to have the pressing position P2 on the right-hand side of the supply position P1 for attaching and detaching the clothes on the body block 1, the pressing position P2 may equally be positioned on the left-hand side of the supply position P1. In any event, the moving distance should be made as short as possible in order to improve the operating efficiency and, in this embodiment, the moving distance between the supply position P1 and the pressing position P2 is a distance corresponding to a breadth of the shoulder of the body block 1 and is about one step which is the minimum moving distance for the operating personnel.

By making the transverse moving distance of the body block 1 equal to the breadth of the shoulders of the body block, even when the body block 1 is moved to the pressing operation position P2, the right-hand sleeve tuck of the clothes placed on the body block 1 (left-hand sleeve as viewed in FIG. 1) still remains in the supply position P1, so that the operating personnel is allowed, while he or she does not have to move, to change the clothes on the body block 1 and to hold the right-hand sleeve tuck of the clothes on the body block 1 on a sleeve holder 41 on the left in FIG. 1. Then, the operation personnel moves to the right in FIG. 1 by one step in order to cause a sleeve holder 41 on the right in FIG. 1 to hold the left sleeve tuck of the clothes on the right in FIG. 1.

The moving mechanism 22 that constitutes the body block moving means is disposed within the press apparatus base 3 and may comprise, although not shown in the drawings, guide rails for guiding the horizontal movement of a moving bed 21, a drive chain for moving the moving bed 21 and a motor or the like for driving the chain.

On the pressing position P2 of the pressing apparatus base 3, the sleeve holders 41, 41 are arranged to extend at both sides of the body block 1 for holding the sleeves of the clothes on the body block 1 in extended positions.

Each of the sleeve holders 41, 41 comprises sleeve tuck iron 42 for pressing the sleeve tuck portion held by the sleeve holders 41, 41. The sleeve holders 41, 41 including the sleeve tuck irons 42, 42 are movably supported on a support post 44 by arms 43 that constitute the sleeve holder moving means.

However, if both sleeve holders 41, 41 are fixed at the position where the extended sleeve tuck portions are to be pressed, they can be obstacles for the body block 1 to move into and out of the pressing position P2, so that the support arm 43 on the left in FIGS. 1 and 2 is movable by an actuator 45 into the retreated position shown in FIG. 4, where the sleeve holder 41 on the left in FIG. 4 that is disposed at the left side of the body block 1 for holding the sleeve cuff of the clothes placed on the body block is arranged such that it can be made retreated by the sleeve holder moving means, such as the actuator 45, into the retreated position from a body block movement space in which the body block 1 travels back and forth.

In this embodiment, as shown in FIGS. 2 and 4, the distance between the body block 1 at the supply position P1 and the body block 1 at the pressing position P2 is only about the breadth of the shoulder of the body block 1, the sleeve holder 41 on the left in FIG. 4 is arranged to be retreated from the position within the body block moving space as shown in FIG. 2. The sleeve holder moving means 43, 43 also includes a function of stretching the sleeve at a suitable tension.

The operations of the various elements of the pressing apparatus, such as the body block moving means 22, the sleeve holder moving means 43, air supply means and the like, including body iron driving means 53, 54 (see FIG. 3) which are driven to press the body irons 51, 52 against the body block 1 from its front and back during the pressing and to separate from the body block 1 after the pressing, are controlled by a controller means 55 or an apparatus controller means.

It is to be noted that, in this embodiment, as shown in FIGS. 1 and 3, the body air bags including the side air bags 11, 11 and the shoulder air bags 12, 12 that have particular pressing conditions are inflated by the air from the body block air supply means 120 including body block air supply source 120M and body block air pipes 120P. Both sleeves are inflated by the air that has particular pressing conditions suitable to directly inflate and stretch the sleeves and that is supplied from the sleeve air supply means 130 separate and independent from the air supply means 120 and including sleeve air supply source 130M and sleeve air supply pipe 120P. The body block air supply means constitutes a first system for supplying air that fulfills the particular pressing conditions for suitably pressing the body portion of the clothes. The body block air supply means 120 comprises an air flow path extending from the air supply source 120M or a blower to the shoulder air bags 12, 12 through the body block air supply pipes 120P. The sleeve air supply means 130 comprises an air flow path extending from the sleeve air supply source 130M to the sleeve air supply ports 13, 13 through the sleeve air supply pipes 130P. The body block air supply means 120 and the sleeve air supply means 130 are controlled by the pressing apparatus controller means 55.

In FIG. 1, both of the blower or the air supply source 120M of the body block air supply means 120 and the blower or the air supply source 130M of the sleeve air supply means 130 are mounted within the press apparatus base 3. Therefore, the joint portions 14 and 15 between the blowers 120M and 130M and the air pipes 120P on the body block 1 transversely movable on the pressing apparatus base 3, that is the joint to the pipes 120P of the body block air supply means 120 and the pipes 130P of the sleeve air supply means 130, are arranged as will be described bellow.

That is, joining ends of the air pipes 120P and the air pipes 130P of the separate systems in the body block 1 are extended within the moving bed 21 of the body block 1 and the joining ends are opened at an end face of the moving bed 21 so that the joining open end automatically mates and communicates with the joining open ends on the side of the blowers 120M and 130M. The connections between these joining ends are established by an elastic hermetic seals 14 and 15 abutting with each other, but may also be established by a simple flexible tubes (not shown) extending between the joining ends.

The operation of the pressing apparatus will now be described in conjunction with FIGS. 1 to 5.

Step 1 (Clothes supplying)

In the initial state, the body block 1 is in the supply position P1 as shown in phantom lines in FIG. 1 and solid liens in FIG. 4, the body irons 51 and 52 are being in the open position, and the sleeve iron 41 on the left in the figures is in the retreated position where the sleeve iron 41 is retreated from the body moving space. With the pressing apparatus in this position, the operating personnel may stand at the supply position P1 and put the clothes such as a dress shirt on the body block 1.

Step 2 (Body block shifting into pressing position)

When the operating personnel depresses a body block travel switch (not shown), the apparatus controller 55 causes the body block moving means 22 to drive the body block 1 into the pressing position P2.

Step 3 (Sleeve holder returning step)

When the body block 1 reaches the pressing position P2, a suitable sensor detects the body block 1 and causes the controller means 55 to actuate the sleeve holder moving means 43 on the left in FIG. 4 to return the sleeve holder 41 on the left in FIG. 4 from its retreated position from the moving space of the body block 1 into the pressing position shown in FIG. 2 where the sleeve pressing can be achieved.

Step 4 (Air pipes connecting step)

When the body block 1 reaches the above pressing position P2, the open joint ends of the air pipes 120P and 130P on the moving bed 21 connected to the body block 1 are brought into intimate contact with the open joint ends of the air pipes 120P and 130 P connected to the blowers 120M and 130M mounted on the pressing apparatus base 3, whereby the blowers 120M and 130M are connected to the air bags 11 and 12 and to the sleeve air supply port 13, respectively.

Step 5 (Body pressing initiation step)

As the controller means 55 detects that the body block 1 is in the press position P2 and that the air pipes 120P and 130P are connected, the controller means 55 operates the body iron drive means 53 and 54 according to a program stored on a memory means in the controller means 55 to initiate the body press operations by the body irons 51 and 52.

Step 6 (Air supply to body air bags)

After the body press operation by the body irons 51 and 52 has been started, the controller means 55 causes the body air supply means 120 to start blasting of air into the body air bags such as side air bags 11, 11 and the shoulder air bags 12, 12 in order to remove wrinkles on the pressed clothes that remain even after the application of the body irons 51 and 52.

The blast of air is applied into the body air bags 11 and 12 in the form of a series of pulses of blast at every 0.1 second after the initiation of the body pressing by the body irons 51 and 52 (step 6), such as immediately after the press by the body irons 51 and 52. This type of pulsating air blast as well as a high pressure air blast for an elongated time is necessary to suitably press the shoulder portion of a dress shirt at which some sheets of clothes are laminated and difficult to press and dry as compared to the sleeve portion of the clothes made of a single sheet of cloth.

Step 7 (setting sleeve cuffs to sleeve holder)

After depressing the body block moving switch in step 1, the operating personnel moves by one step sideward to stand at the press position P2 and attaches the sleeve cuffs of the clothes on the body block 1 now located at the press position P2 to the sleeve holders 41, 41 on the both sides of the body block 1. Since the sleeve holders 41, 41 of this embodiment are of the clip type, attachment of the sleeves can be made in one action.

Also, the attaching of the sleeves of the clothes placed on the body block 1 to the sleeve holders 41, 41 is carried out after the body block 1 stops at the pressing position P2 the sleeve holder 41 on the left in FIG. 1 returns to the side of the body block 1 and prior to the supplying of the air to the sleeves or the sleeve air supply ports 13, 13, whereby the operating efficiency can be improved.

Step 8 (press finishing step)

After the sleeve cuffs of the clothes on the body block 1 is attached to the sleeve holders 41, 41 in step 7, the press finishing start switch (not shown) is depressed. Then the controller means 55 causes the sleeve holders 41, 41 to pull in the direction of extension by means of the sleeve holder moving means 43, 43 on the basis of the finishing start signal for starting the press finishing until the sleeves are extended at their full lengths.

Step 9 (Sleeve Pressing)

The controller means then causes the sleeve air supply means 130 to operated to initiate the air blasting into both sleeves, which are pressed by the blast of inflating air.

Step 10 (sleeve tack pressing step)

The controller means then causes the sleeve tack irons 42, 42 mounted to the sleeve holders 41, 41 to apply to the tack portions of the sleeves to initiate the press finishing procedure.

Step 11 (pressing operation complete)

After a lapse of a predetermined time period from the time point measured on the basis of a body press operation start signal indicating that the body press operation by the body irons 51, 52 in step 5 is started, or on the basis of a stop signal indicating that the body block 1 stops at the pressing position P2 and a connection signal indicating that the air pipes 120P and 130P are connected, the apparatus controller means 55 terminate all kinds of the pressing operations at the same time. All kinds of the pressing operations in this embodiment means the body pressing operations by the body irons 51 and 52 in step 5 and by the body air supply means 120 in step 6, the sleeve pressing operation by the sleeve air supply means 130 in step 9 and the sleeve tuck pressing operation by the sleeve tuck irons 42, 42.

Step 12 (initial state returning)

Finally, after all the pressing operations are completed in step 11, the controller means 55 causes the sleeve holder 41 on the left in the figure to retreat backward from the body block moving space and then causes the body block 1 to move into the supply position P1, thereby returning the clothes pressing apparatus into the initial state (FIG. 4). The above steps 1 to 12 constitute one cycle of the clothes pressing process.

According to the clothes pressing method as above described, the air supply into the sleeves by the sleeve air supply means 130 is started after a lapse of a predetermined time from the start of the air supply to the body air bags 11 and 12 by the body air supply means 120 immediately after the start of the body pressing operation by the body irons 51 and 52. The above predetermined time is set to be a time necessary to simultaneously terminate the pressing of the body and the sleeve portions of the clothes. Therefore, as understood from FIG. 5, within the time period necessary for the body pressing operation which usually takes the longest time, other pressing operations such as the sleeve pressing operation and the sleeve tuck pressing operation can be completed, thus all of the pressing operations can be efficiently completed within a short time.

It is to be noted that "at the same time" in this application should not be interpreted in its strict meaning, but should be interpreted to include some time difference of 4 or 5 seconds.

Also, the sleeve air supply port 13 refers to the air port in the body block facing to the cylindrical portion of the sleeve of the clothes and should not be limited to any particular configuration. Also, the sleeve air supply port 13 may have connected thereto a sleeve air bag, which requires different press conditions from the body air bag.

The present invention is applicable not only to the clothes pressing apparatus of the above described embodiment, but also to all kinds of clothes pressing apparatus.

What is claimed is:

1. A clothes pressing method for pressing an article of clothing with a clothes pressing apparatus that comprises a body block having a body air bag and a sleeve air supply port, a body iron, a sleeve holder, body air supply means, and sleeve air supply means, comprising:

placing the article of clothing on a body block;

supplying a first air blast at first press conditions for pressing the body portion of the article of clothing against the body air bag to press the body portion; and supplying a second air blast at second press conditions, different from the first press conditions, to the sleeve air supply port, only during the supply of the first air blast, pressing a sleeve portion of the article of clothing, wherein sleeve holders are disposed at oposite sides of the body block for holding sleeve cuffs of the article of clothing placed on the body block and including retracting one of the sleeve holders from a body block movement space when the body block is moved between the supply position and the press position.

2. The clothes pressing method as claimed in claim 1, including stopping the first air blast and the second air blast at substantially the same time.

3. The clothes pressing method as claimed in claim 1, further comprising, after placing the article of clothing on the body block, moving the body block from a supply position, at which the article of clothing is placed on the body block, to a press position, at which the pressing of the article of clothing on the body block is achieved.

4. The clothes pressing method as claimed in claim 3, including moving the body block a sufficient distance so that a sleeve tuck of the article of clothing placed on the body block and moved to the press position is within the supply position.

5. The clothes pressing method as claimed in claim 1, including operating the body air supply means, the body iron, the sleeve air supply means, and a sleeve tuck iron are operated in the order named, and terminating operations of the body air supply means, the sleeve air supply means, and sleeve tuck iron at substantially the same time.

6. The clothes pressing method as claimed in claim 5, including holding a sleeve of the article of clothing placed on the body block with the sleeve holder after the body block stops at the pressing position and prior to the supplying of the second air blast air to the sleeves.

7. A clothes pressing apparatus comprising:

a body block having a body air bag and a sleeve air supply port;

a body iron;

body air supply means for supplying a first air blast at first press conditions for pressing the body portion of an article of clothing against the body air bag, pressing a body portion of the article of clothing;

sleeve air supply means for supplying a second air blast at second press conditions, different from the first press conditions, for pressing a sleeve portion of the article of clothing, pressing the sleeve portion of the article of clothing;

controller means for operating said sleeve air supply means for supplying the second air blast only when the body air supply means is operated for supplying the first air blast;

a base movably supporting said body block, said body block being movable between a supply position at which the article of clothing to be pressed can be placed on the body block and a press position to which the body block can be transversely moved from the supply position and at which the pressing can be achieved; and a sleeve holder mounted on said base for holding sleeves and having a sleeve tucking iron, wherein said controller means controls each of the body air supply means and the sleeve air supply means, and initiates air supply by the sleeve air supplying means after a lapse of a predetermined period of time after initiation of air supply by the body air supplying means, and the predetermined time period is a time necessay for concurrently completing the pressing of the body and the sleeve portions of the article of clothing.

8. The clothes pressing apparatus as claimed in claim 7, wherein distance of the movement of the body block is such that a sleeve tuck of the article of clothing placed on the body block and moved to the press position is within a region of the supply position.

9. A clothes pressing apparatus comprising:

a body block having a body air bag and a sleeve air supply port;

a body iron;

body air supply means for supplying a first air blast at first press conditions for pressing the body portion of an article of clothing against the body air bag, pressing a body portion of the article of clothing;

sleeve air supply means for supplying a second air blast at second press conditions, different from the first press conditions for pressing a sleeve portion of the article of clothing, pressing the sleeve portion of the article of clothing;

controller means for operating said sleeve air supply means for supplying the second air blast only when the body air supply means is operated for supplying the first air blast;

a base movably supporting said body block, said body block being movable between a supply position at which the article of clothin to be pressed can be placed on the body block and a press position to which the body block can be transversely moved from the supply position and at which the pressing can be achieved; and a sleeve holder mounted on said base for holding sleeves and having a sleeve tucking iron, wherein said controller means controls each of the body air supply means and the sleeve air supply means, and initiates air supply by the sleeve air supplying means after a lapse of a predetermined period of time after initiation of air supply by the body air supplying means, and the sleeve holder is movable between an operable position at which the sleeve holder is located at a side of the body block and a retracted position at which the sleeve holder allows the body block to move between the supply position and the press position.

10. The clothes pressing apparatus as claimed in claim 7, wherein the controller means initiates operations of the body iron, the body air supply means, the sleeve air supply means, and a sleeve tucking iron in the order named, and the controller means terminates operations of the body air supply means, the sleeve air supply means, and the sleeve tucking iron at substantially the same time.

* * * * *